US005713534A

United States Patent [19]

McClenathan et al.

[11] Patent Number: 5,713,534

[45] Date of Patent: Feb. 3, 1998

[54] CONTINUOUS WEB WINDING APPARATUS

[75] Inventors: John A. McClenathan, Oneonta, Ala.; Robert Burns Douglass, McKinney, Tex.

[73] Assignee: IMD Corporation, Birmingham, Ala.

[21] Appl. No.: 493,410

[22] Filed: Jun. 22, 1995

[51] Int. Cl.[6] ..... B65H 35/08

[52] U.S. Cl. ..... 242/527.1; 242/531; 242/534; 242/535; 242/541.4; 242/542.3

[58] Field of Search ..... 242/523, 527.1, 242/527.4, 534.2, 554, 554.1, 554.4, 523.1, 530.4, 541, 541.7, 542.3, 531, 531.1, 534, 535, 541.4

[56] References Cited

U.S. PATENT DOCUMENTS

| | | | |
|---|---|---|---|
| 4,171,107 | 10/1979 | Kayser et al. | 242/541.6 |
| 4,491,283 | 1/1985 | Pav et al. | 242/534.2 |
| 4,529,141 | 7/1985 | McClenathan | 242/527.1 |
| 4,736,605 | 4/1988 | Klockner et al. | 242/547 X |
| 5,377,931 | 1/1995 | Dorfel et al. | 242/547 X |

*Primary Examiner*—John M. Jillions
*Assistant Examiner*—William A. Rivera
*Attorney, Agent, or Firm*—Veal & Associates

[57] ABSTRACT

A web winding and severing apparatus using a linear carriage arrangement wherein the cores are positioned relative to feed to a winding drum in a bilateral manner such that a core is always adjacent to the drum ready to receive the leading edge of the web. A pair of reciprocating carriages are mounted on a frame which supports a winding drum for rotation. The carriages movement relative to the drum is independent, yet coordinated such that as one carriage carries a filling winding core, the other stands ready on the opposite side of the winding drum with an empty core. As the web is severed the second carriage positions its core to become the winding core and the first carriage moves away to off-load the full core, then, returns to a ready position with a fresh core.

9 Claims, 8 Drawing Sheets

CONTINUOUS WEB WINDING APPARATUS

FIELD OF THE INVENTION

The present invention relates to web winding apparatus wherein a continuous web is provided to a plurality of winding stations for winding on cores, such that the web may be iteratively severed as each core is filled and the leading edge of the severed web engaged on an empty core. In more particularity the present invention relates to the means for delivering the cores into position to receive the web. In even greater particularity the present invention relates to the control of the cores as they are presented and removed from the web wrapping apparatus and how the web is presented to the cores.

BACKGROUND

An understanding of the severing mechanism employed in this type apparatus may be had from U.S. Pat. No. 4,529,141, issued Jul. 16, 1985, which is incorporated herein by reference. Turret delivery mechanisms are well known in the art for delivering and retrieving cores and full process rolls from web winding apparatus. Although such mechanisms work well for their intended purpose, certain web winding applications utilize web width and weight factors which make the use of turret delivery systems unwieldy as well as unreliable with respect to positioning the active core adjacent to the winding drum. Therefore, a new approach to delivery and retrieval of the core is needed to handle the physical constraints imposed by a five foot wide web. Further the apparatus embodied in my above mentioned patent utilized a completely different drive arrangement to transfer the severed web.

SUMMARY OF THE INVENTION

It is the principal object of the invention to provide a means for accurately positioning a core on which a web is being or is to be wound relative to the web delivery mechanism.

Another object of the invention is to provide a core positioning mechanism which can achieve the above object and which can also rapidly change rolls to facilitate the continuous transfer of web to a core after a first core and the web has been severed on the fly.

A still further object is to create a smooth transverse edge which is transferred to the subsequent core in a wrinkle free manner.

These and other objects and advantages of our invention are accomplished using a linear carriage arrangement wherein the cores are delivered to the winding drum in a bilateral manner such that a core is always adjacent to the drum, ready to receive the leading edge of the web. A pair of reciprocating carriages are mounted on a frame which supports the winding drum for rotation. The carriage's movement relative to the drum is independent, yet coordinated such that as one carriage carries a winding core, the other stands ready on the opposite side of the winding drum. As the web is severed, the second carriage positions its core to become the winding core and the first carriage moves away to off-load the full core, then, returns to a ready position with an empty a fresh core.

BRIEF DESCRIPTION OF THE DRAWINGS

Apparatus embodying features of the invention are depicted in the accompanying drawings which form a portion of this disclosure and wherein.

DESCRIPTION OF THE PREFERRED EMBODIMENT

Figure 1:
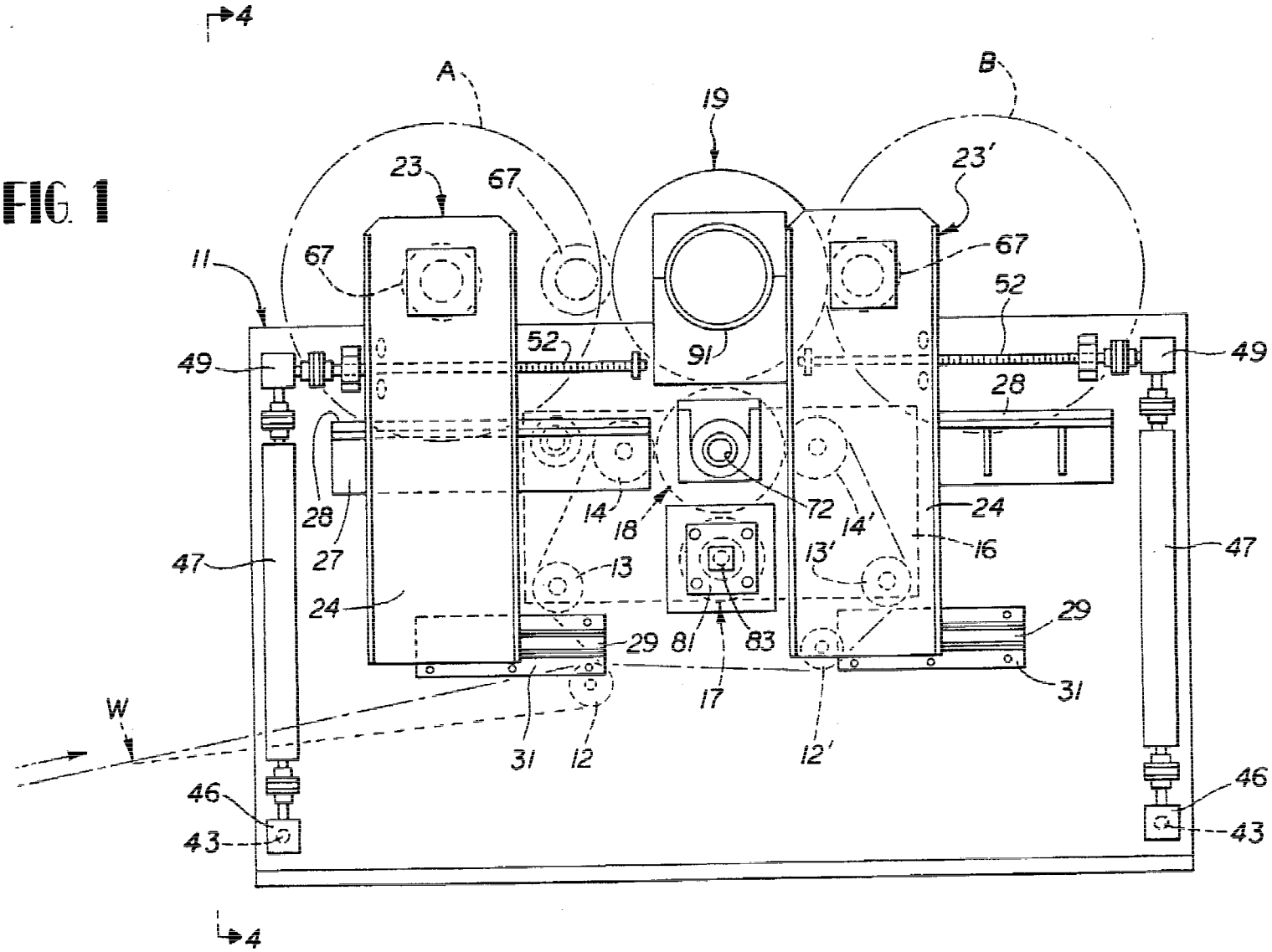
FIG. 1 is a side elevational view of the invention from the operator's side of the apparatus.
Figure 4:
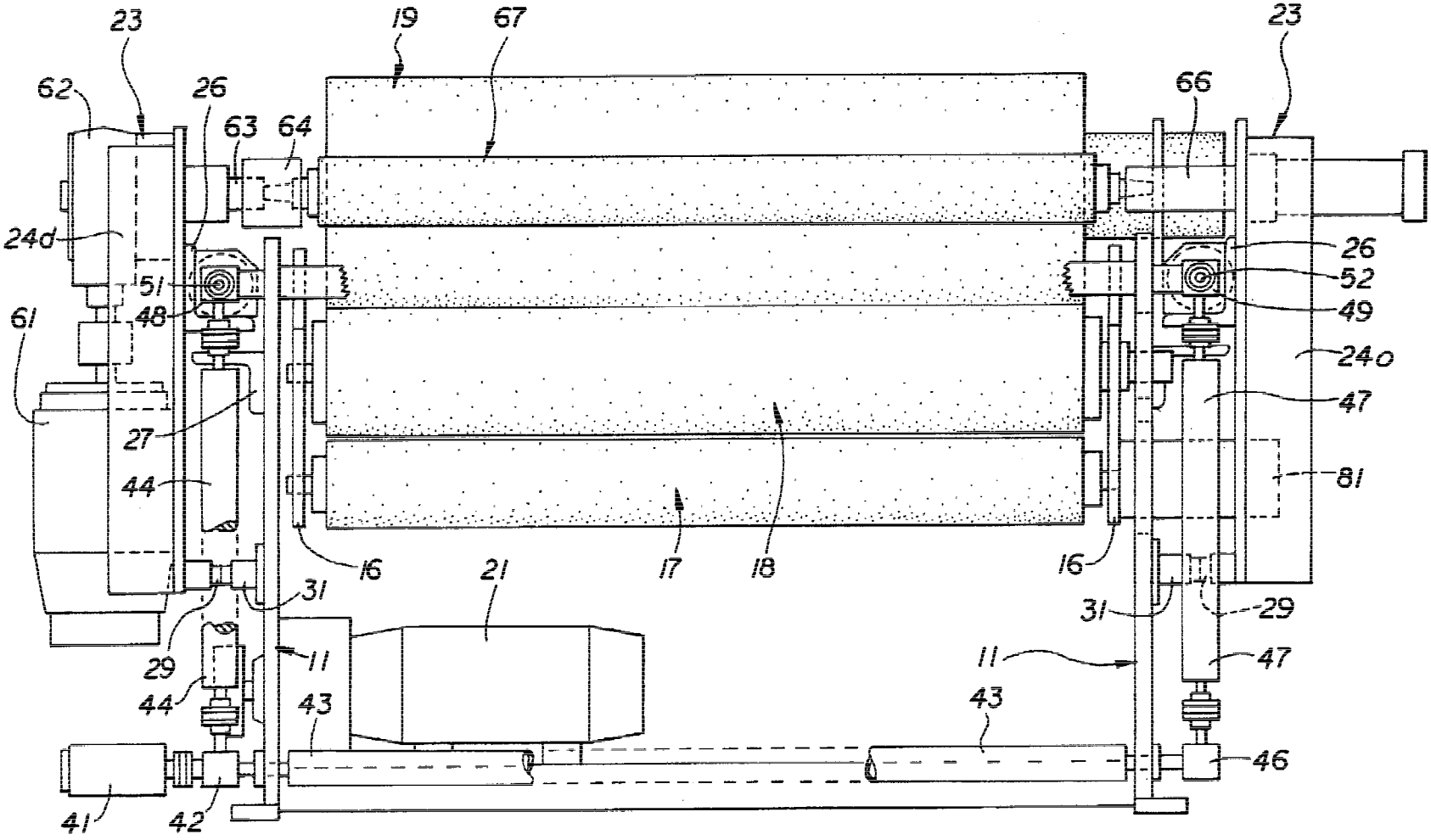
FIG. 4 is an end view of the apparatus.

Referring to the figures for a clearer understanding of the invention, it may be seen in FIG. 1, that the invention is an apparatus for handling large rolls of web like material W. The apparatus has a large support frame which shall be indicated in common by the numeral 11. This frame 11 may take on many configurations and have many subparts which are not germane to the instant invention other than to provide support to the operative components, therefore in the interest of clarity and conciseness, specific frame members are not recited or indicated by separate numerals. As may be seen frame 11 supports idler rollers 12 and 12' in appropriate bearings. Idler rollers 13, 13' and nip rollers 14, 14' are mounted on adjustment plate 16 which can be used to adjust tension in the web W as shown in FIG. 4.

Figure 2:
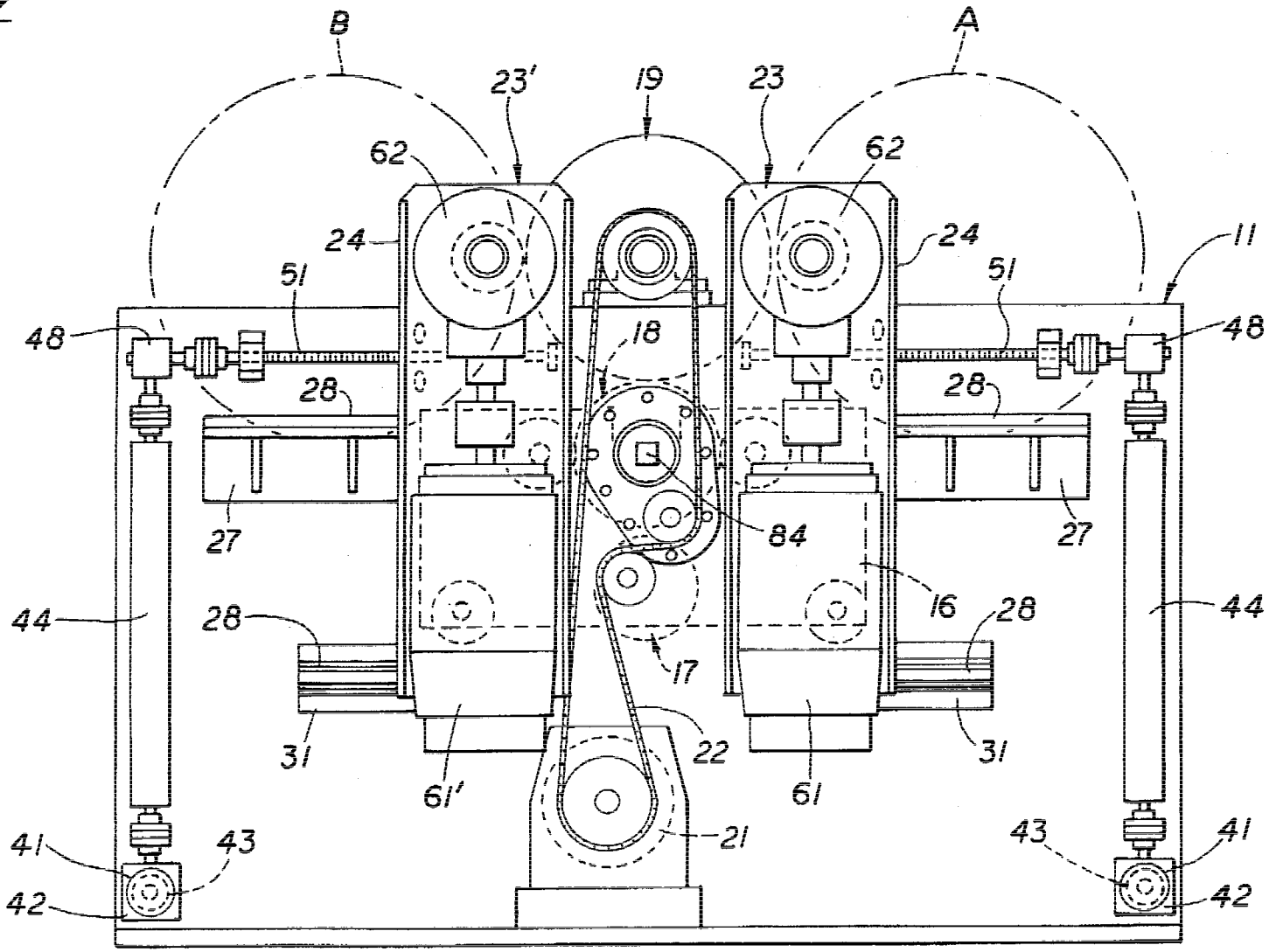
FIG. 2 is a side elevational view of the invention from the drive side of the apparatus.

A knife roll 17 is supported for selective driven rotation on frame 16 in appropriate bearings and is flanked by the idler rollers. Superjacent knife roll 17 is a vacuum transfer roll 18, which is also supported on frame 16 for driven rotation such that the adjacent surfaces of knife roll 17 and transfer roll 18 move in the same direction. Superjacent vacuum transfer roll 18 is a winding drum 19, which is likewise driven for cooperative rotation with transfer roll 18. Roll 18 and drum 19 constitute transfer surfaces over which the web must move to reach a winding core. Each surface rotates about a fixed axis on the frame 11. In FIG. 2, it may be seen that a DC motor 21 drives an endless belt 22 which drives vacuum transfer roll 18 and winding drum 19.

Inasmuch as the winding drum 19 rotates about a stationary axis, it can be seen that the cores onto which the web must be wound must be movable relative to the winding drum 19. This is accomplished using cooperative carriages 23 and 23'. Carriage 23 has complimentary components on the operator side and drive side of the apparatus, as does carriage 23'. The complementary component will be designated as d or o, when it is necessary to differentiate the side of the apparatus being discussed. The carriages 23, 23' are each supported on frame 11 on a set of vertically spaced guide tracks, as seen in FIGS. 1, 2, & 4. As may be seen, each carriage includes a carriage frame 24 which has affixed thereto an angle 26 in cooperative relation to an angle 27 mounted to main frame 11. Intermediate angles 26 and 27 is a linear bearing 28 such that the carriage frame 24 is supported on the flanges and bearing for horizontal linear motion along the bearing. A second linear bearing 29 is mounted between a lower guide track 31 and frame 24 at the bottom thereof. Each carriage frame is thus mounted to the frame 11 in a manner that allows smooth linear reciprocal motion relative to the winding drum 19.

The drive mechanism for the carriages is seen in FIGS. 1–4. For each carriage we provide a servo drive 41, connected via a gear box 42 to a transverse drive shaft 43 and a first vertical drive shaft 44. Transverse drive shaft 43 extends across the width of the apparatus and is connected to a second gear box 46, which transfers drive force to a second vertical drive shaft 47. Each vertical drive shaft 44 and 47 terminates in an upper gear box 48 and 49, respectively, which is operatively connected to a drive screw 51 and 52 respectively. The drive screws are supported for rotation on main frame 11 parallel to the upper linear bearings 28 supporting the associated carriage frames 24.

Each drive screw has mounted thereon a drive nut 53 which moves linearly along the screw responsive to rotation of the screw. Each drive nut is mounted to a drive plate 54, which is connected to a mounting plate 56 affixed to carriage frame 24. The drive screw 51 or 52 extends through an opening in the mounting plate, but does not interact directly with the mounting plate 56. Drive plate 54 is connected to mounting plate 56 by a plurality of spacer rods 57 which are affixed to one plate and slidably received through the other plate. The rods 57 may in reality be bolts threadably received in one plate and passing through apertures in the other plate such that the other plate is movable along the length of the rod and captured thereon by the head of the bolt. Intermediate the drive plate and the mounting plate is a toriodal compressible bladder 58, which may be pneumatically filled to provide an elastic spacer intermediate the drive plate 54 and the mounting plate 56. The separation between plate 54 and plate 56 with bladder 58 filled is precisely known, such that a transducer assembly 59 may be used to sense compression of the bladder caused by force applied to the mounting plate and output an electrical signal in accordance with the sensed compression. As will be described hereinafter, this signal may be used as a control signal for the servo drive 41 to rotate the screw and move the drive plate 54 therealong.

Figure 3:
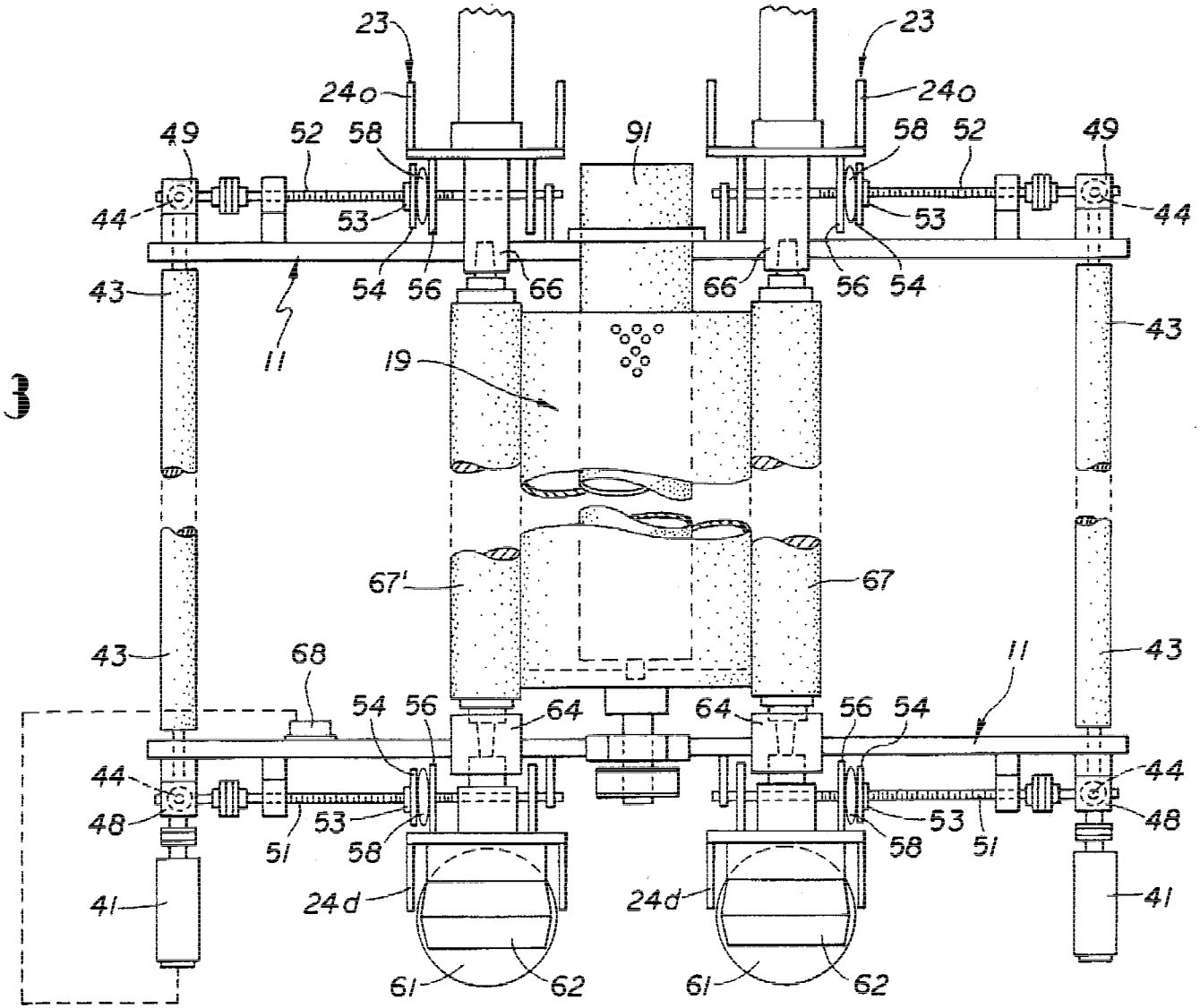
FIG. 3 is a top plan view of the invention.
Figure 8:
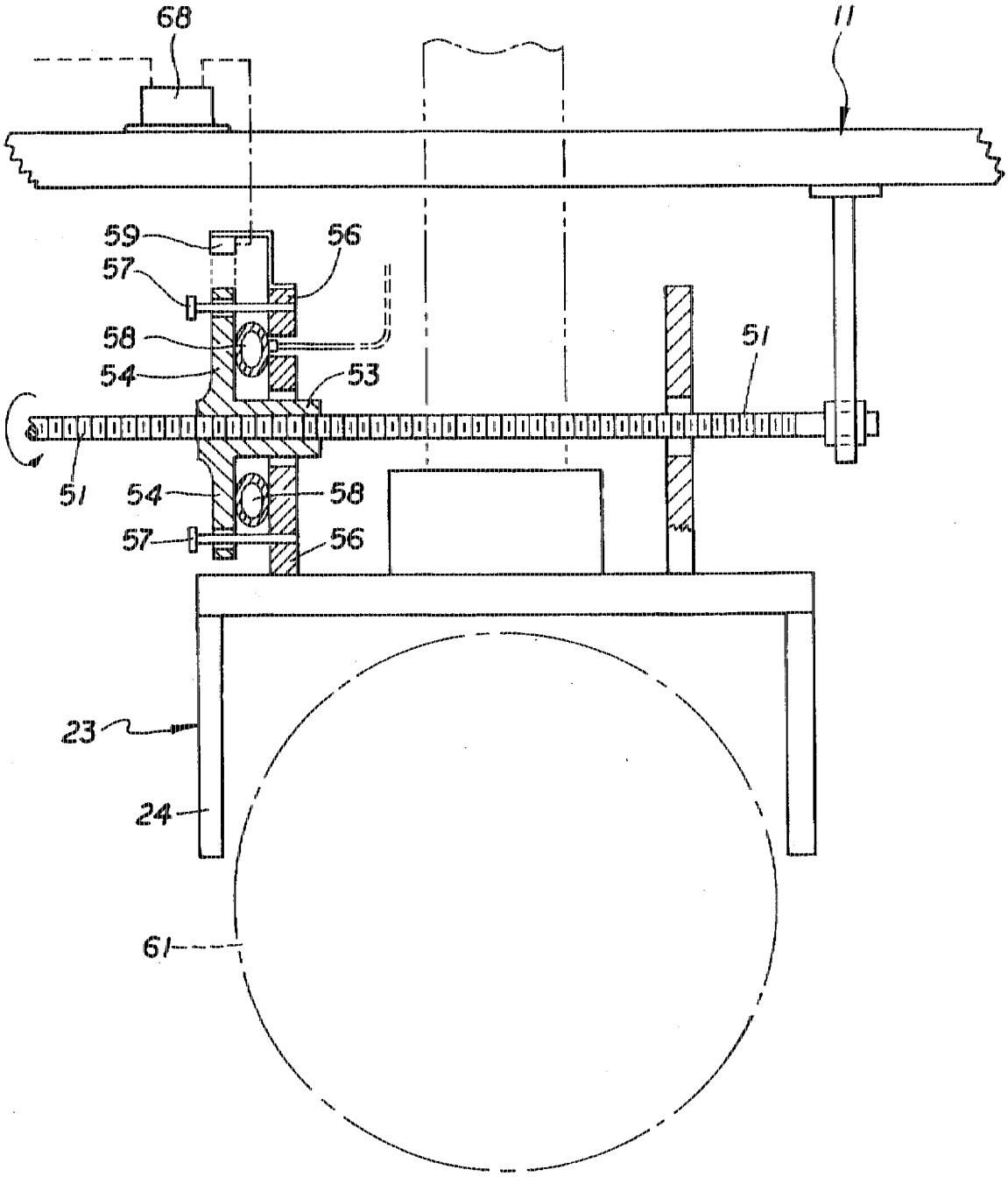
FIG. 8 is a detail plan view of the carriage mount and drive components.

As shown in FIG. 3, carriage frame 24*d* supports a DC motor 61 which is used to rotate the core on which a web W is received. The output of motor 61 is to a gearbox 62 also supported on carriage 24*d*, to a spindle 63 on which a core chuck 64 is mounted. On carriage frame 24*o* a cooperative core chuck 66 is mounted such that a core 67 may be affixed intermediate chuck 64 and chuck 66 for driven rotation, about an axis parallel to the axis of rotation of winding drum 19. As will now be appreciated, a core 67 mounted on a carriage 23 or 23' is movable relative to the winding drum in response to rotation of drive screws 51 and 52. Accordingly, a web W may be delivered to the core by passing over the idler rollers, the transfer surfaces of roll 18 and drum 19 to the core. In one mode of operation, the core 67 is in a nip relation with the winding drum 19 which is rotating about a fixed axis. As the web accumulates on the core 67, the diameter of the core and layers of web and hence the thickness of the web passing between the core and the winding drum increases, thus applying force to the carriage which is transferred to the bladder 58 by mounting plate 56, compressing the bladder and thereby outputting an analog control signal via transducer assembly 59 to a motion control processor 68 which also controls the servo drive 41 (See FIGS. 4 & 8). Servo drive 41 then continuously receives signals representative of the compression of the bladder which are proportional to the accumulation of web on the core. The servo drive responds to position the core in a null signal position. Accordingly, as the web accumulates the core is moved appropriately.

In some instances it may be desirable to wind a web onto a core without contact between the accumulated web and the winding drum. In such cases the core needs to be moved to maintain a gap between the surface of the accumulated web and the drum. Accordingly, in our invention we include a means for controlling the position of the core which is dependent on the rate at which the web accumulates on the core and the thickness of each layer as it accumulates. In one embodiment the rotational speed of the core is used to determine the rate of accumulation and a constant for the thickness of the web is incorporated into the calculation of the thickness of the accumulated web. In another form of calculation, the rotational speed of the winding drum is used to determine the rate of accumulation. In either case, the desired gap is known, the linear rate of feed of the web is known and size and position of the core relative to the drive screw and winding drum at the start of accumulation is known. Accordingly, the movement of the core is calculated in accordance with the formula:

Position relative to a home position=D−g−r, where D=the distance from the winding drum to the core surface with the core in the home position, r=the radius of the core as the web accumulates, thereon, and g=the gap desired between the winding drum and the surface of the web, wherein r varies proportionally with the thickness of the web and the linear rate feed of the web to the core.

When the desired length of web W has been accumulated on a core supported on one winding station between the chucks of one carriage, the present invention allows for the web to be severed and the leading edge thereof to be carried to another core supported on the other winding station mounted on the other carriage. A clearer understanding of the structure and method embodying this invention will be had by reference to FIGS. 5 & 6. In the sectional view of FIG. 5 it may be seen that vacuum transfer roll 18 is a perforated roll having a plenum therewithin. The plenum is divided into longitudinal segments by a series of vanes 71 extending from a stationary vacuum tube 72 with the largest being a vacuum plenum, extending over 270 degrees of angular measure within the roll. Each vane carries a seal 73 which is interposed against the interior of the roll. In addition to the vacuum plenum 70 a pair of blow off plenums 77 and 78 are formed at right angles to each other and adjacent the walls of plenum 70. Conduits for delivery of forced air from a remote source extend within vacuum tube 71 in communication with blow off plenums 77 and 78. An anvil slot 79 is formed longitudinally in vacuum transfer roll 18 to receive a knife 80 carried by knife roll 16. Knife roll 16 embodies the teachings of U.S. Pat. No. 4,529,141 in terms of urging the knife into a cutting position, however, the actual control of the knife roll is somewhat different. In the present invention the knife roll is driven by a direct drive D.C. motor 81 coupled to the axis and controlled by a servo drive and encoder circuit 83, such that a pacer encoder 84 on the vacuum transfer roll 18 axis can be used to provide a signal to a motion control processor 68 to determine the relative position of the slot 79 to the closest point of approach (CPA) of the surfaces of the knife roll and the vacuum transfer roll. In operation, the knife roll 17 starts at a home position 240 degrees from the CPA and at rest. Upon receiving a signal that the web W is to be severed, the motion control processor 86 determines the speed and position of the slot 79 based on the pacer encoder 84 signal. At the appropriate time motor 81 accelerates the knife roll 17 such that after 320 degrees of rotation the knife roll surface speed is matched to the vacuum transfer roll surface speed at 10 degrees before the knife reaches the CPA. The knife engages the slot within +/-0.005". At 10 degrees past the CPA the knife roll 17 begins to decelerate such that it stops within 330 degrees of travel. After stoppage the D.C. motor 81 is reversed to return the knife to the home position.

Figure 5:
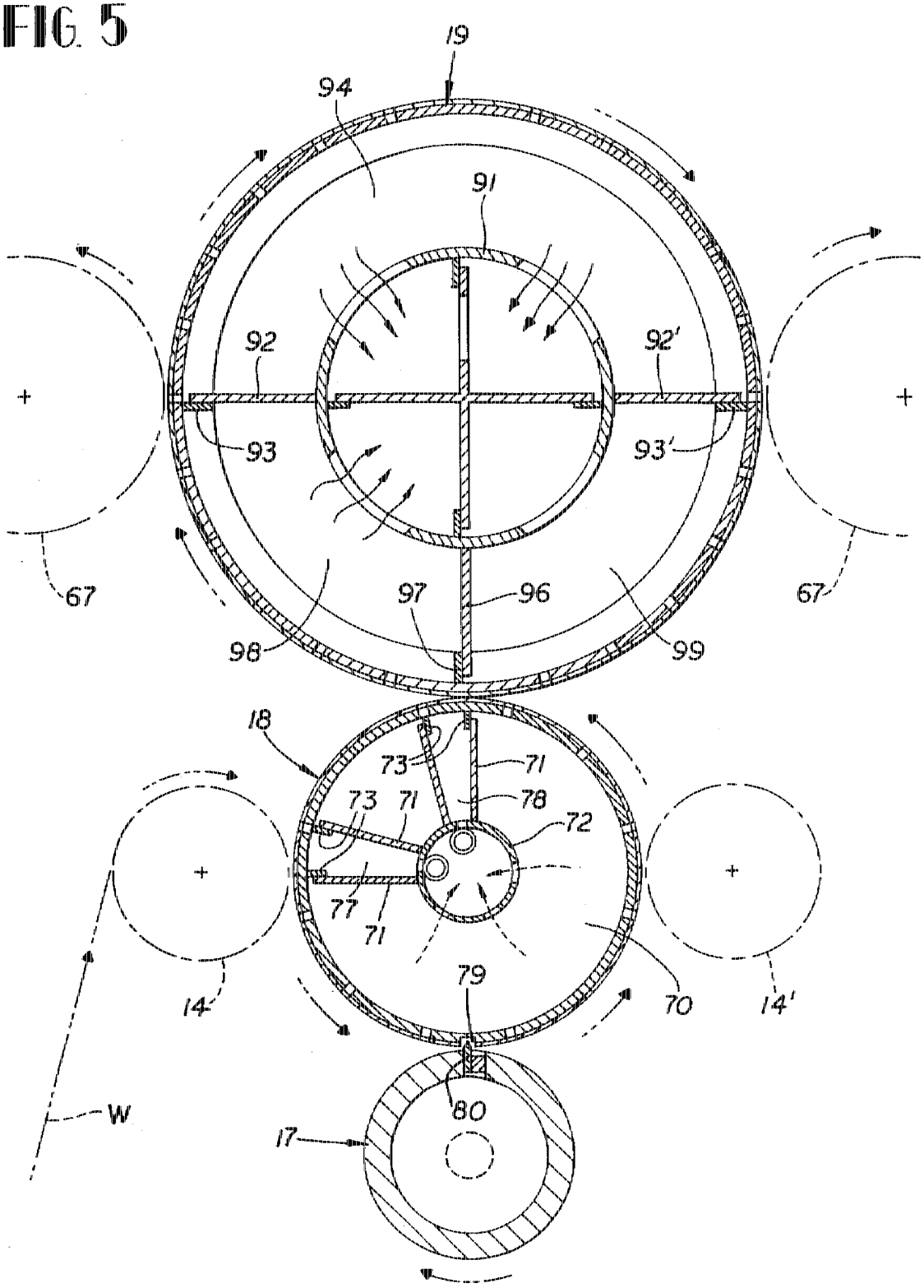
FIG. 5 is a sectional view taken transversely of the winding drum.
Figure 6:
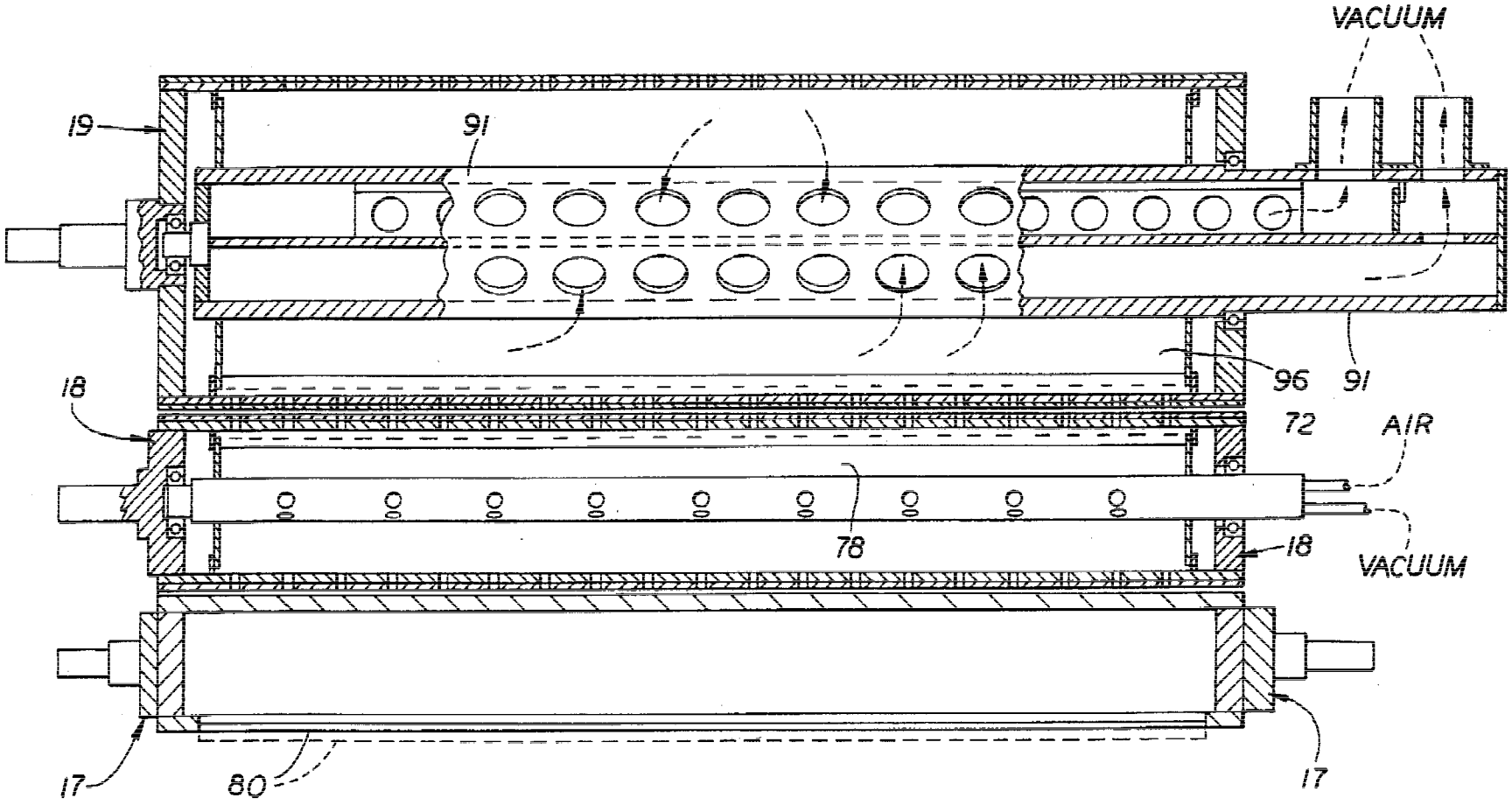
FIG. 6 is a sectional view taken longitudinally of the winding drum and vacuum transfer roll.
Figure 7:
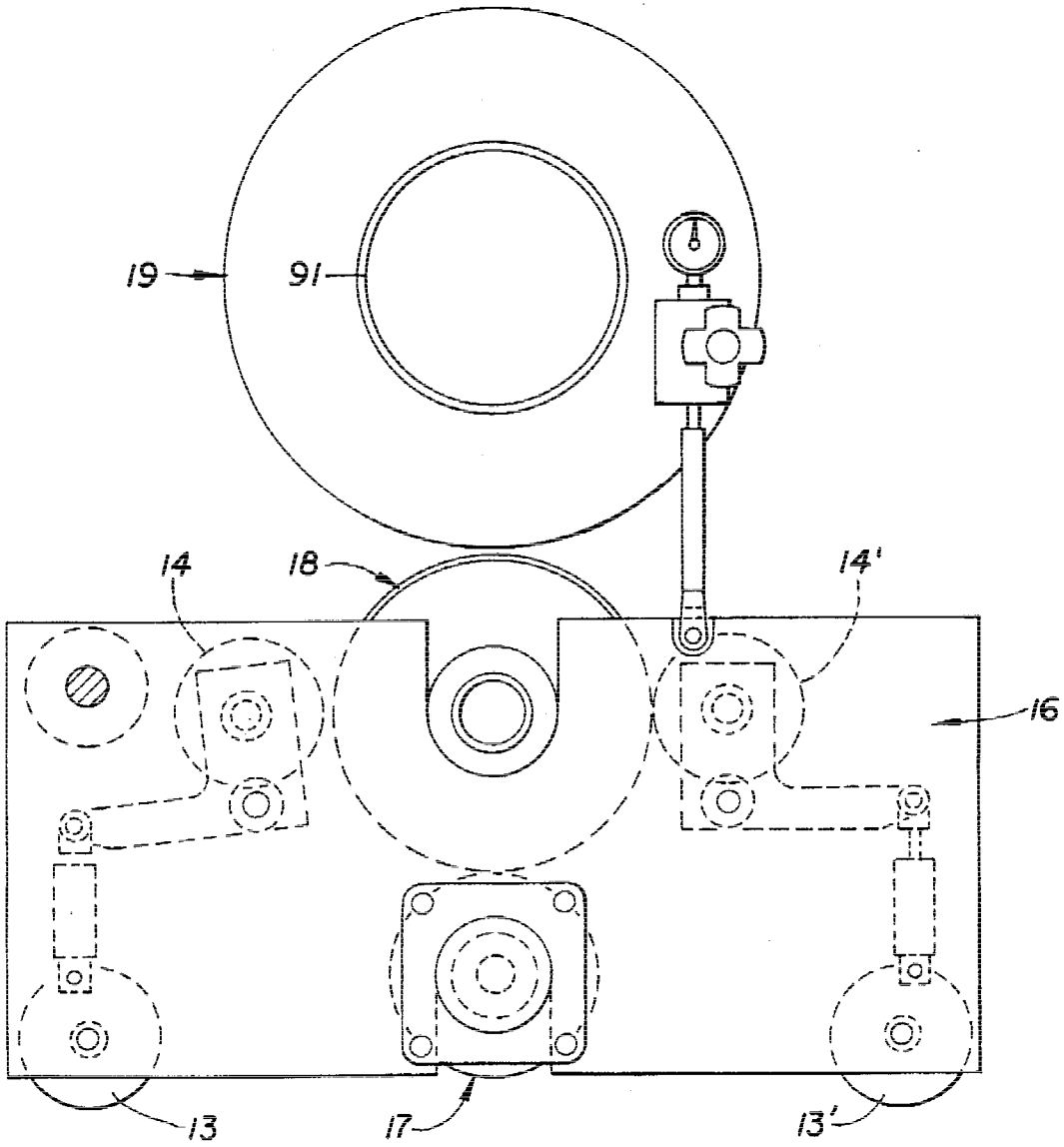
FIG. 7 is a side elevational view of the tensioning apparatus.

Winding drum 19 is also of a special construction, as may be seen in FIGS. 5 & 6. Winding drum 19 defines a tubular plenum, and is perforated to allow a radial airflow. The drum 19 is concentric with a vacuum tube 91 which is in communication with the drum plenum and a remote vacuum to induce air flow into the plenum. A pair of diametrically opposed vanes 92 and 92' extend radially from tube 91 and bifurcate the plenum externally of tube 91. Wiper seals 93 and 93' close the space between vanes 92, 92' and the inner surface of drum 19 to define an upper vacuum chamber 94 which extends over the upper 180 degrees of the winding drum 19. A subtending vane 96 spaced along a radian bisecting the lower 180 degrees of the winding drum 19 carries a wiper seal 97 and defines a pair of lower vacuum chambers 98 and 99 which extend over the lower arcuate quadrants of the winding drum.

While there are numerous details of construction which have been omitted, the forgoing description is deemed sufficient to enable the artisan to construct the apparatus.

The operation of the apparatus is as follows. With reference to the FIGS., one core 67 has been designated A and the other B. With core A winding in the nip winding mode, core A and the web W accumulating thereon is in contact with the winding drum and no vacuum is applied to any drum or roll. Core B is an empty core carried by carriage 23' and has a splice tape affixed thereto such that it may adhere to the leading edge of the web to be wound. Core B is moved to a reload position, such as 12 inches from the web on the winding drum 19, under the control of motion control processor 86.

Core B has it's own D.C. drive motor 61' which is a variable speed motor and is initially set to match the surface speed of the core to the winding drum 19. The vacuum is applied to the vacuum transfer roll 18 and to the winding drum 19. The knife roll 17 is at the home position and accelerates to line speed such that the knife blade 80 mates with the anvil slot 79 and severs the web just after core B is nipped to the winding drum. A positive air flow is introduced through the blow off conduit and plenum intermediate the CPA and core B such that the leading edge of the web W is carried by the winding drum to nipped core B for adhesion to the transfer tape as the trailing edge of the web on core A is carried past core B by the winding drum. Core B is positioned to wind web thereon in a nip position or a gap position and motion control processor signals the drive for carriage 23 to move core A to the home position as the core coasts to a stop. As will be understood the vacuum applied by the vacuum transfer roll 18 is applied from the nip roller 14 past the CPA to the nip of the winding drum 19, thus the vacuum is applied over about 270 degrees of rotation of the roll. The blow off plenum 78 is positioned downstream of the winding drum nip such that the leading edge of the web is positively lifted from the transfer surface of the roll. Simultaneously, the vacuum within the winding drum 19 is applied from the nip of the vacuum transfer roll 18 to the nip of the fresh core, through the lower vacuum plenum and, if necessary, the upper vacuum plenum. The vacuum is adjustable to permit clockwise or counter clockwise rotation of the transfer surfaces as desired.

From the foregoing description of the structure and the operation, it should be clear that we have provided a web splicing device which is amenable to large capacities in terms of web weight and size, and which can provide continuous operation of the web winding apparatus with virtually no folds at the core interface.

While we have shown our invention in one form, it will be obvious to those skilled in the art that it is not so limited, but is susceptible of various changes and modifications without departing from the spirit thereof.

What I claim is:

1. Apparatus for winding and serving an elongated, continuously delivered web to a winding core and transferring a leading edge of the remaining web to an empty core comprising, in combination:

(a.) a winding drum mounted at a fixed position for rotation about an axis transverse to the length of said web;

(b.) a plurality of core mounting stations adjacent said winding drum and means for moving each of said plurality of core mounting stations independently and radially relative thereto between a winding position proximal said winding drum and a home position distal said winding drum, said means for moving including carriage means for supporting said plurality of core mounting stations such that the core mounted in each station thereof for driven rotation about an axis parallel to the axis of the winding drum; means for selectively reciprocating said carriage means along a linear path to deliver a first one of said core mounting stations to a winding position and a second of said core mounting stations to a home position, responsive to an accumulation of web on a core supported at said winding position, including means for sensing the accumulation of web on an adjacent core supported at said winding position to provide a control signal to said reciprocating means, wherein said means for sensing comprises at least one compressible member mounted on said carriage means such that said compressible member is elastically deformed as web accumulates on said core at said winding position, means for sensing the deformation of said compressible member and outputting a control signal responsive thereto;

(c.) means for delivering said web to said winding drum for transfer to a core at one of said plurality of core mounting stations while at said winding position; and, (d.) means for severing said web while in said delivering means such that said leading edge is captured by said delivering means and transferred to said winding roll.

2. Apparatus as defined in claim 1 wherein said delivering means comprises:

a vacuum transfer roll including means for selectively applying a retaining vacuum to a web carried thereon over a predetermined angular measure of said roll; and vacuum means within said winding drum for selectively applying a retaining vacuum to a web carried thereon over a predetermined angular measure of said drum.

3. Apparatus for winding and serving an elongated, continuously delivered web to a winding core and transferring a leading edge of a served web to an empty core, comprising in combination:

(a) a winding drum mounted at a fixed position for rotation about an axis transverse to the length of said web;

(b.) a plurality of core mounting stations adjacent said winding drum and movable radially relative thereto between a winding position proximal said winding drum and a home position distal said winding drum;

(c.) means for delivering said web to said winding drum for transfer to a core at one of said plurality of core mounting stations while at said winding position;

(d.) means for severing said web while on said delivering means such that the leading edge is captured by said delivering means and transferred to said winding drum;

(e.) means for moving each of said plurality of core mounting stations between said home position and said winding position including carriage means for supporting said plurality of core mounting stations such that the core mounted in each station thereof for driven rotation about an axis parallel to the axis of the winding drum and means for selectively reciprocating said carriage means along a linear path to deliver a first one of said core mounting stations to a winding position and a second of said core mounting stations to a home position, responsive to an accumulation of web on a core supported at said winding position, said means for selectively reciprocating including means for sensing the accumulation of web on an adjacent core supported at said winding position to provide a control signal to said reciprocating means, wherein said means for sensing comprises at least one compressible member mounted on said carriage means such that said compressible member is elastically deformed as web accumulates on said core at said winding position, means for sensing the deformation of said compressible member and outputting a control signal responsive thereto, a mounting plate affixed to said carriage means adjacent said compressible member, a drive plate affixed to said means for reciprocating adjacent said compressible member such that said compressible member is captured between said drive plate and said mounting plate and, means for connecting said drive plate and said mounting plate in variable spaced relation such that said compressible member is dynamically compressed in accordance with the separation therebetween, with said means for sensing operatively connected to sense said separation.

4. Apparatus for winding and severing an elongated, continuously delivered web to a winding core and transferring a leading edge of a severed web to an empty core, comprising in combination:

(a.) a winding drum mounted at a fixed position for rotation about an axis transverse to the length of said web;

(b.) a plurality of core mounting stations adjacent said winding drum and movable radially relative thereto between a winding position proximal said winding drum and a home position distal said winding drum;

(c.) means for delivering said web to said winding drum for transfer to a core at one of said plurality of core mounting stations while at said winding position;

(d.) means for severing said web while on said delivering means such that the leading edge is captured by said delivering means and transferred to said winding drum;

(e.) means for moving each of said plurality of core mounting stations between said home position and said winding position including carriage means for supporting said plurality of core mounting stations such that the core mounted in each station thereof for driven rotation about an axis parallel to the axis of the winding drum and means for selectively reciprocating said carriage means along a linear path to deliver a first one of said core mounting stations to a winding position and a second of said core mounting stations to a home position, responsive to an accumulation of web on a core supported at said winding position, said means for selectively reciprocating including means for sensing the accumulation of web on an adjacent core supported at said winding position to provide a control signal to said reciprocating means, further comprising:

a mounting plate affixed to said carriage means;

a drive plate affixed to said means for reciprocating;

a compressible member captured between said drive plate and said mounting plate; and, means for connecting said drive plate and said mounting plate in variable spaced relation such that said compressible member is dynamically compressed as a function of the separation therebetween, with said means for sensing operatively connected to sense the separation.

5. Apparatus for winding and severing an elongated, continuously delivered web to a winding core and transferring a leading edge of a severed web to an empty core, comprising, in combination:

(a.) a winding drum mounted at a fixed position for rotation about an axis transverse to the length of said web;

(b.) a plurality of core mounting stations adjacent said winding drum and movable radially relative thereto between a winding position proximal said winding drum and a home position distal said winding drum;

(c.) means for delivering said web to said winding drum for transfer to a core at one of said plurality of core mounting stations while at said winding position;

(d.) means for severing said web while on said delivering means such that the leading edge is captured by said delivering means and transferred to said winding drum;

(e.) means for moving each of said plurality of core mounting stations between said home position and said winding position including carriage means for supporting said plurality of core mounting stations such that the core mounted in each station thereof for driven rotation about an axis parallel to the axis of the winding drum and means for selectively reciprocating said carriage means along a linear path to deliver a first one of said core mounting stations to a winding position and a second of said core mounting stations to a home position, responsive to an accumulation of web on a core supported at said winding position; programmable means for calculating the desired position of a core supported on a carriage relative to said winding drum as a function of the rate of accumulation of web on said supported core, said programmable means having an output signal to said reciprocating means for controlling the position of said core in accordance with said calculated position wherein said programmable means is programmed to calculate the desired position to establish a gap between said winding drum and the surface of the web accumulated on said supported core in accordance with the formula:

Position relative to a home position=D−g−r, where

D=the distance from the winding drum to the core surface with the core in the home position, r=the radius of the core as the web accumulates, thereon, and g=the gap desired between the winding drum and the surface of the web accumulated on said core, wherein r varies proportionally with the thickness of the web and the linear rate feed of the web to the core.

6. Apparatus for winding a web of material onto cores such that the web is continuously fed into the apparatus and sequentially wound onto cores, with the web being severed intermediate the cores, comprising in combination:

a. a winding drum mounted at a fixed location on a supporting frame for rotation about a longitudinal axis transverse to the feed direction of a web moving relative to said winding drum;

b. a pair of carriages supported on said frame for linear movement between a home position at which a core is supported distal said winding drum and a winding position at which a core is supported proximal said winding drum;

c. means for controlling the position of said pair of carriages in accordance with the amount of web accumulated on a winding core supported at said winding position including at least one compressible member mounted on each of said plurality of carriages such that said compressible member is deformed as web accumulates on the core supported at said winding position and means for sensing the deformation of said compressible member;

d. a knife roll having a movable knife therein supported for controlled movement relative to said web to sever said web transversely; and, e. a vacuum transfer roll mounted for rotation intermediate said winding drum and knife roll and parallel thereto, said roll having a perforated transfer surface over which said web is conveyed and a controllable source of vacuum therein.

7. Apparatus for winding a web of material onto cores such that the web is continuously fed into the apparatus and sequentially wound onto cores, with the web being severed intermediate the cores, comprising in combination:

(a.) a winding drum mounted at a fixed location on a supporting frame for rotation about a longitudinal axis transverse to the feed direction of a web moving relative to said winding drum;

(b.) a pair of carriages supported on said frame for linear movement between a home position at which a core is supported distal said winding drum and a winding position at which a core is supported proximal said winding drum;

(c.) means for controlling the position of said pair carriages in accordance with the amount of web accumulated on a winding core supported at said winding position, means for sensing the accumulation of web on an adjacent core supported on one of said pair of carriages to provide a control signal to a means for reciprocally moving said carriage, wherein said means for sensing comprises at least one compressible member mounted on each carriage such that said compressible member is elastically deformed as web accumulates on said carried core, means for sensing the deformation of said compressible member and outputting a control signal responsive thereto, and a mounting plate affixed to each of said pair of carriages adjacent said compressible member, a drive plate affixed to said means for reciprocally moving adjacent said compressible member such that said compressible member is captured between said drive plate and said mounting plate; and, means for connecting said drive plate and said mounting plate in variable spaced relation such that said compressible member is dynamically compressed as the separation therebetween is reduced, with said means for sensing operatively connected to sense the separation therebetween; and, (d.) a knife roll having a movable knife therein supported for controlled movement relative to said web to sever said web transversely; and, (e.) a vacuum transfer roll mounted for rotation intermediate said winding drum and knife roll and parallel thereto, said roll having a perforated transfer surface over which said web is conveyed and a controllable source of vacuum therein.

8. Apparatus for winding a web of material onto cores such that the web is continuously fed into the apparatus and sequentially wound onto cores, with the web being severed intermediate the cores, comprising in combination:

a. a winding drum mounted at a fixed location on a supporting frame for rotation about a longitudinal axis transverse to the feed direction of a web moving relative to said winding drum;

b. a pair of carriages supported on said frame for linear movement between a home position at which a core is supported distal said winding drum and a winding position at which a core supported proximal said winding drum;

c. means for controlling the position of said pair of carriages in accordance with the amount of web accumulated on a winding core supported at said winding position, wherein said position controlling means comprises programmable means for calculating the desired position of a core supported on one of said pair of carriages relative to said winding drum as a function of the rate of accumulation of web on said supported core, said programmable means having an output signal to said reciprocating means for controlling the position of said core in accordance with said calculated position wherein said programmable means is programmed to calculate the desired position to establish a gap between said winding drum and the surface of the web accumulated on said supported core in accordance with the formula:

$$\text{Position relative to a home position} = D - g - r$$

where:

D=the distance from the winding drum to the core surface with the drum in the home position, r=the radius of the core as the web accumulates thereon, and g=the gap desired between the winding drum and the surface of the web accumulated on said core, wherein r varies proportionally with the thickness of the web and the linear feed of the web to the core;

d. a knife roll having a moveable knife therein supported for controlled movement relative to said web to sever said web transversely; and e. a vacuum transfer roll mounted for rotation intermediate said winding drum and knife roll and parallel thereto, said roll having a perforated transfer surface over which said web is conveyed and a controllable source of vacuum therein.

9. Apparatus for winding an elongated, continuously delivered, web to a winding core, for transversely severing said web and transferring a leading edge of said severed web to an empty core comprising, in combination:

a. a winding drum mounted at a fixed position for rotation about an axis transverse to the length of said web;

b. a pair of core mounting stations adjacent said winding drum and supported on carriage means for radial movement, relative to said drum, of a core supported in one of said core mounting stations between a winding position proximal said winding roll and a home position distal said winding roll;

c. means connected to said carriage means in variable spaced relation thereto for selectively reciprocating said carriage means along a linear path to move said core between said positions including means for sensing the accumulation of web on said core supported at said winding position to provide a control signal to said reciprocating means, said sensing means including a compressible member captured between said carriage means and said reciprocating means for dynamic compression in accordance with the separation therebetween, such that said sensing means is operatively connected to sense compression of said compressible member;

d. means for delivering said web to said winding drum for transfer to a core while at said winding position; and, e. means for severing said web while in said delivering means such that said leading edge is captured by said delivering means and transferred to said winding drum.

* * * * *